US005954533A

United States Patent [19]

Hatagishi et al.

[11] Patent Number: 5,954,533

[45] Date of Patent: Sep. 21, 1999

[54] CRIMPING CONNECTOR

[75] Inventors: Yuji Hatagishi; Hiroshi Yamamoto, both of Shizuoka, Japan

[73] Assignee: Yazaki Corporation, Tokyo, Japan

[21] Appl. No.: 08/900,536

[22] Filed: Jul. 25, 1997

[30] Foreign Application Priority Data

Jul. 25, 1996 [JP] Japan ..... 8-196582

[51] Int. Cl.[6] ..... H01R 4/24

[52] U.S. Cl. ..... 439/397; 439/936; 439/942

[58] Field of Search ..... 439/877, 397–400, 439/936, 204, 276

[56] References Cited

FOREIGN PATENT DOCUMENTS 61-161880 10/1986 Japan ..... H01R 4/24
2-99569 8/1990 Japan ..... H01R 4/24
5-274930 10/1993 Japan ..... H01B 13/00
7-201395 8/1995 Japan ..... H01R 13/405

*Primary Examiner*—Neil Abrams
*Assistant Examiner*—J. F. Duverne
*Attorney, Agent, or Firm*—Sughrue, Mion, Zinn, Macpeak & Seas, PLLC

[57] ABSTRACT

In a crimping connector 10 in which a crimping terminal 20 having an electric contact portion 21 with a mating connector on a front end thereof and a wire pressuring portion 22 on a back end thereof is inserted and set into a terminal accommodating chamber 12 of a connector housing 11, and in which a wire 4 is pressured and connected to the wire pressuring portion 22, the interior of the terminal accommodating chamber 12 is separated into a front chamber 12F and a back chamber 12B with a shield wall 23 interposed between the wire pressuring portion 22 and the electric contact portion 22 of the crimping terminal 20, and a pressured and connected portion 29 of the wire is molded with resin by charging a resin 30 into the back chamber 12B. Further, an elastic bent portion 24 is interposed between the shield wall 23 and the electric contact portion 21.

28 Claims, 8 Drawing Sheets

CRIMPING CONNECTOR

BACKGROUND OF THE INVENTION

The invention relates to a crimping connector in which the pressured and connected portion of a wire with respect to a crimping terminal is molded with resin so that wire holding strength is increased.

As disclosed in Japanese Utility Model Unexamined Publication No. Hei. 2-99569, wire holding power has heretofore been reinforced by molding with resin the pressured and connected portion of a wire with respect to a crimping terminal.

FIG. 1 is a diagram illustrative of the art disclosed in the aforementioned publication. FIG. 1(*a*) is a perspective view showing a condition before the pressured and connected portion of a wire is protected by resin; and FIG. 1(*b*) is a sectional view showing a structure after the pressured and connected portion has been protected by resin.

In this art, wires 4 are pressured and connected to U-shaped slot portions 1 of crimping terminals 2, and the lower portion of these pressured and connected portions 2*a* of the wires is thereafter fitted into a recessed portion 3*a* of a receiving member 3 as shown in FIG. 1(*a*). Then, the thus processed part is set in a not shown separately prepared mold, and by charging a resin into the receiving member 3, the protecting structure in which almost entire part of each crimping terminal 2 is molded with resin is obtained.

However, if the aforementioned prior art is to be applied to a crimping connector, a special mold must be employed for molding. In addition, assembling processes such as not to be suited for automation must be adopted. Therefore, it is not reasonable to apply the prior art without any modification. That is, if the prior art is applied to a crimping connector, performed are the assembling process including the steps of: pressuring and connecting a wire to a crimping terminal; setting the thus processed crimping terminal in a separately prepared mold; thereafter molding the thus set crimping terminal with resin; and finally assembling the thus molded crimping terminal into the connector housing. As a result, a manufacturing process suited for automation, i.e., a manufacturing process in which the wire pressuring operation is performed with many crimping terminals set in the connector housing, cannot be adopted. Hence, it is difficult to automate the aforementioned manufacturing process based on the prior art.

SUMMARY OF THE INVENTION

The invention has been made in view of the aforementioned circumstances. The object of the invention is, therefore, to provide a crimping connector in which the pressured and connected portions of wires can be molded with resin by directly charging a resin into a connector housing while preventing the resin from entering into the electric contact portions of crimping terminals accommodated in the connector housing and in which no special mold must be employed and manufacturing process suitable for automation can be adopted directly.

A first aspect of the invention is applied to a crimping connector comprising:

a connector housing having a terminal accommodating chamber;

a crimping terminal inserted and set into the terminal accommodating chamber of the connector housing, the crimping terminal having an electric contact portion relative to a mating connector terminal on a front end thereof a wire pressuring portion on a back end thereof; and a wire pressured and connected to the wire pressuring portion;

wherein the crimping terminal is provided with a shield wall arranged between the wire pressuring portion and the electric contact portion of the crimping terminal for separating an interior of the terminal accommodating chamber into a front chamber accommodating the electric contact portion and a back chamber accommodating the wire pressuring portion, and a resin is charged into the back chamber so as to cover a pressured and connected portion of the wire connected to the wire pressuring portion.

In this crimping connector, when a crimping terminal is set to a regular position within a terminal accommodating chamber, the shield wall arranged on the crimping terminal separates the interior of the terminal accommodating chamber into the front chamber and the back chamber. Therefore, by charging a resin into the back chamber, only the pressured and connected portion of a wire can be molded with resin while blocking the resin from flowing toward the front chamber.

A second aspect of the invention is applied to a crimping connector according to the first aspect of the invention, the crimping connector being characterized in that the crimping terminal is provided with an elastically deformable portion which is arranged between the shield wall and the electric contact portion of the crimping terminal for allowing slight movement of the electric contact portion.

In this crimping connector, the elastic bent portion is arranged between the shield wall and the electric contact portion of the crimping terminal. Therefore, the electric contact portion on the front end can be supported with some degree of play even though the back portion of the crimping terminal is immovably fixed by the resin.

A third aspect of the invention is applied to a crimping connector according to the first or the second aspect of the invention, the crimping connector being characterized in that the connector housing is provided with an opening portion allowing an upper surface of the back chamber to open.

In this crimping connector, not only the upper surface of the back chamber of the connector housing is opened, but also the back wall for closing the back end face of the back chamber is arranged. Therefore, a molding resin can be charged from the opening formed in the upper surface of the back chamber while leaving the upper surface faced upward. For the charging operation, the back wall plays the role of preventing the resin from flowing, and the pressured and connected portion of a wire can be molded by the resin charged into the back chamber naturally solidifying.

A fourth aspect of the invention is applied to a crimping connector according to the third aspect of the invention, the crimping connector being characterized in that a wire insertion hole is formed in the back wall.

In this crimping connector, a wire can be inserted into the wire insertion hole formed in the back wall. Therefore, the wire is no longer required to be extended from the opening formed in the upper surface of the back chamber, which in turn ensures reliable wire holding power.

A fifth aspect of the invention is applied to a crimping connector according to the fourth aspect of the invention, the crimping connector being characterized in that the wire insertion hole is formed so as to be large enough to allow the wire to be in intimate contact therewith and so as to be of substantially the same height as the pressured and connected portion of the wire; and a plurality of radially extending slits are formed around the wire insertion hole.

In this crimping connector, the wire insertion hole is arranged so as to be of substantially the same height as the pressured and connected portion of a wire. Therefore, the wire can be extended without being forcibly bent, etc. Further, the wire insertion hole is so dimensioned that the wire comes in intimate contact therewith. Therefore, leakage of the resin charged into the back chamber can be minimized. Still further, a plurality of radially extending slits are arranged in the wall around the wire insertion hole. Therefore, the wire can be inserted into the wire insertion hole easily with a small force.

A sixth aspect of the invention is applied to a crimping connector according to the fourth aspect of the invention, the crimping connector being characterized in that the wire insertion hole is arranged at a level higher than a resin charging height in the back chamber, and also a notch allowing the wire to be inserted into the wire insertion hole from above is formed above the wire insertion hole in the back wall.

In this crimping connector, a wire can be fitted into the wire insertion hole from above by utilizing the notch. Therefore, there is no need for inserting the wire into the wire insertion hole.

A seventh aspect of the invention is applied to a crimping connector according to any one of the third to sixth aspects of the invention, the crimping connector being characterized in that the connector housing comprises two connector housing members each having the terminal accommodating chamber with the opening portion allowing an upper surface of the back chamber to open, and the two connector housing members are combined so as to confront the opening portion of one of the connector housing members with the opening portion of the other connector housing members.

In this connector, the openings of one of the connector housings are concealed by the openings of the other connector housing while combining the two connector housings together. Further, the pressured and connected portion of a wire inside the opening is molded with resin. Therefore, even if both connector housings are combined together, there is no likelihood that the pressured and connected portion in one of the connector housings will come in contact with that in the other connector housing.

An eighth aspect of the invention is applied to a crimping connector according to the seventh aspect of the invention, the crimping connector being characterized in that the two connector housing members are coupled to each other through a coupling band in such a manner that the opening portion of the one of the connector housing members confront the opening portion of the other connector housing members while the two connector housing members are combined.

In this crimping connector, both connector housings can be combined together easily with the coupling band as a hinge. Further, both connector housings can be set with the openings thereof faced upward. Therefore, the wire pressuring operation and the resin charging operation can be performed at the same time.

BRIEF DESCRIPTION OF THE DRAWINGS

FIG. 1(*b*) is a sectional view showing the pressured portion of a wire is protected by resin;

FIG. 3(*b*) is a diagram showing a condition in which a wire is pressured and connected to a wire pressuring portion of the crimping terminal; FIG. 3(*c*) is a diagram showing a condition in which the crimping terminal is moved to an assembling position on the front side (regularly setting position); and FIG. 3(*d*) is a diagram showing a condition in which the pressured and connected portion of the wire is molded with resin by charging a resin into a back chamber of the terminal accommodating chamber;

FIG. 5(*b*) is a diagram showing a condition in which the pressured and connected portion of the wire is molded with resin by charging a resin into a back chamber of the terminal accommodating chamber from an opening formed in the upper surface;

FIG. 6(*b*) is an enlarged view of a portion Vb in FIG. 6(*a*);

FIG. 7(*b*) is a general side sectional view showing a condition in which a pressured and connected portion of the wire is molded with resin by charging a resin into the back chamber of the terminal accommodating chamber from an opening formed in the upper surface;

FIG. 9(*b*) is a general side sectional view showing a condition in which a pressured and connected portion of the wire is molded with resin by charging a resin into the back chamber of the terminal accommodating chamber from an opening formed in the upper surface.

DETAILED DESCRIPTION OF THE PREFERRED EMBODIMENTS

Embodiment of the invention will now be described with reference to the drawings.

Figure 1A:
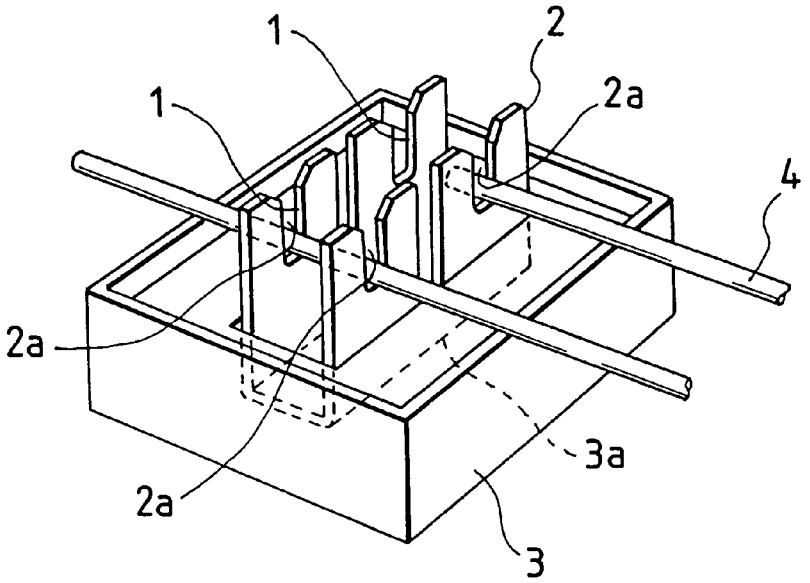
FIG. 1(a) PRIOR ART
FIGS. 1(*a*) and 1(*b*) are diagrams illustrative of a conventional wire pressuring portion protecting technique; i.e., FIG. 1(*a*) is a perspective view before the pressured portions of wires are molded with resin.
Figure 1B:
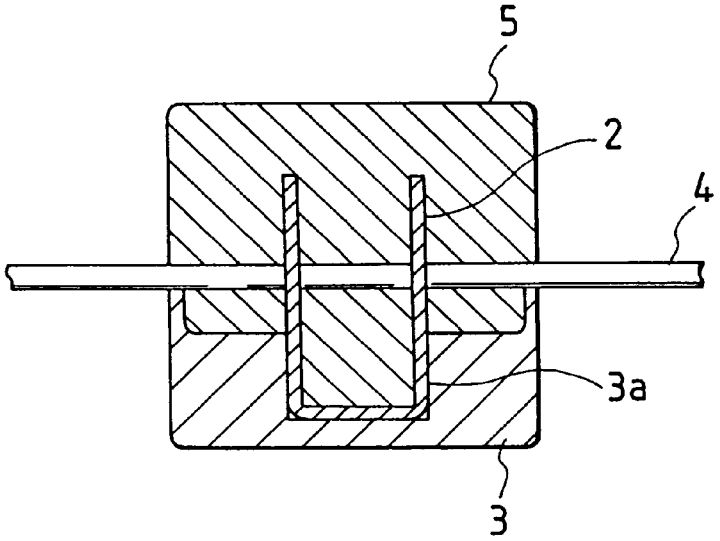
FIG. 1(b) PRIOR ART
Figure 2:
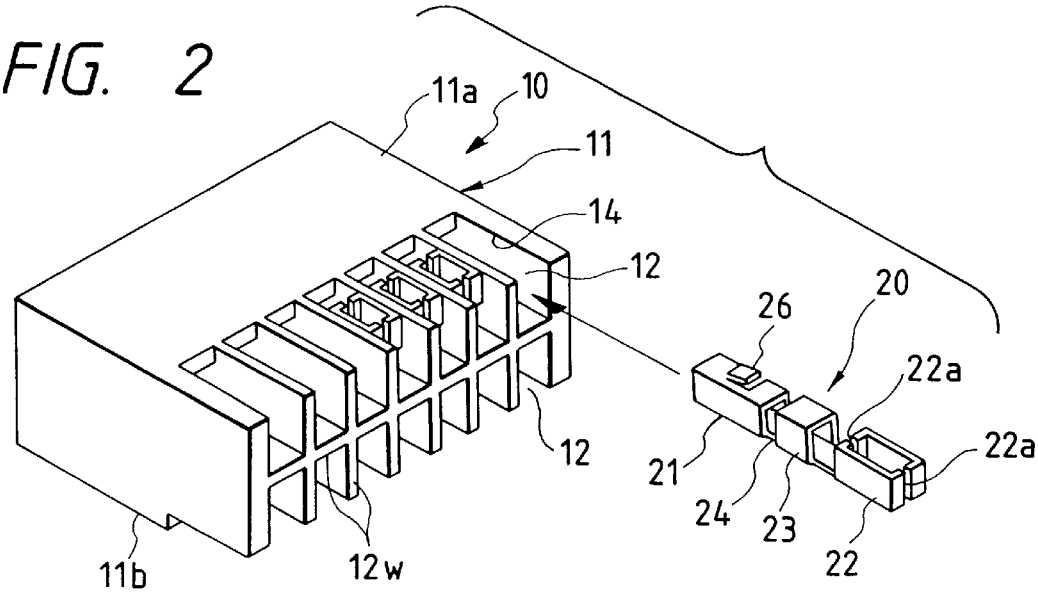
FIG. 2 is a perspective view showing a connector housing and a crimping terminal in a crimping connector, which is a first embodiment of the invention.

FIG. 2 is a perspective view of a pressure connector, which is a first embodiment of the invention, in a preassembled condition; and FIGS. 3(*a*) to 3(*d*) are side sectional views showing an assembling process.

As shown in FIG. 2, a connector housing 11 of this pressure connector 10 has a rectangular boxlike form, and has two-storied terminal accommodating chambers 12 between an upper wall 11*a* and a lower wall 11*b* thereof. The terminal accommodating chambers 12 in each story are juxtaposed in a horizontal row and are partitioned from one another by partition walls 12*w*. The front end of a terminal accommodating chamber 12 is, as shown in FIG. 3(*a*), communicates with the outside through an insertion hole 12*a* for a mating connector terminal 100 arranged on the front wall of the connector housing 11, and the back end thereof is totally opened.

Since the terminal accommodating chambers 12 in the upper story is symmetrical with those in the lower story, only the terminal accommodating chambers 12 in the upper story will be hereinafter described. The upper surface of the back portion of a terminal accommodating chamber 12 is opened by an opening 14 arranged in the back half of the upper wall 11*a*. Further, a projected portion 13 is arranged on an inner side surface of the terminal accommodating chamber 12.

A pressure terminal 20 to be accommodated in this connector housing 11 has an electric contact portion 21 with a mating connector terminal (not shown) on the front end thereof and a wire pressuring portion 22 on the back end thereof. Between the wire pressuring portion 22 and the electric contact portion 21 is a shield wall 23. As shown a partial sectional view of the shield wall 23 in FIG. 3(*a*), the shield wall 23 is T-shaped in section. As shown in FIG. 3(*a*) and 3(*c*), the shield wall 23 with an inner wall section 23*a* separates the interior of the terminal accommodating chamber 12 into a front chamber 12F and a back chamber 12B when the pressure terminal 20 is set to a regular setting position within the terminal accommodating chamber 12. Slot portions 22*a* are arranged in the wire pressuring portion 22 in two stages in the front and in the back. Each slot portion 22*a* allows a wire 4 to be electrically connected only by fitting the wire 4 thereinto from above.

Further, between the shield wall 23 and the electric contact portion 21 is an elastic bent portion 24. The elastic bent portion 24, being wave-shaped, permits slight movement of the electric contact portion 21 even if the back portion of the pressure terminal 20 is immovably fixed. The electric contact portion 21 in this embodiment is formed into a boxlike shape, and has a retaining lance 26 formed on the upper surface thereof. The retaining lance 26 engages with the connector housing 11 when the pressure terminal is inserted into the terminal accommodating chamber 12.

For assembling the pressure connector 10 according to this embodiment, at first, a pressure terminal 20 is inserted and set into a terminal accommodating chamber 12 of the connector housing 11 as shown in FIG. 3(*a*). In this case, the pressure terminal 20 is inserted from the back of the connector housing 11 and temporarily held at a backward position for performing the pressuring operation.

Then, as shown in FIG. 3(*b*), a wire 4 is pressured and connected to the wire pressuring portion 22 of the pressure terminal 20 from above utilizing the opening 14 formed in the upper surface. As shown in FIG. 3(*c*), the pressure terminal 20 is thereafter pushed frontward, so that the pressure terminal 20 can be set to the regular setting position. At this moment, the retaining lance 26 engages with a projection and a hole (not shown) of the inner wall of the terminal accommodating chamber 12, so that the pressure terminal 20 is unreleasably retained. It is under the same condition that a pressured and connected portion 29 of the wire is located inward with respect to where the opening 14 is located.

Further, the shield wall 23 of the pressure terminal 20 is brought into contact with the projected portion 13 on the inner wall of the terminal accommodating chamber 12, so that the shield wall 23 separates the interior of the terminal accommodating chamber 12 into the front chamber 12F and the back chamber 12B. Then, as shown in FIG. 3(*d*), a resin 30 is charged into the back chamber 12B under the same condition, so that only the pressured and connected portion 29 of the wire can be molded with resin while preventing the resin 30 from flowing toward the front chamber 12F. When the resin 30 has solidified, the crimping connector 10 according to this embodiment is completed. It may be noted that the flowing of the resin 30 toward the back can be prevented by setting the connector housing 11 to an erect position.

This crimping connector 10 is characterized in that only the pressured and connected portion of a wire can be molded with resin by charging the resin 30 into the connector housing 11 while preventing the resin from flowing toward the electric contact portion 21 of a crimping terminal 20. Therefore, not only the wire holding power can be improved by resin molding, but also the crimping terminal 20 can be fixed reliably. Further, the resin 30 can be charged into the connector housing 11 directly. Therefore, it is not necessary to prepare a special mold for the molding operation. Still further, the assembling operation is performed in such a sequence as to first insert and set a crimping terminal 20 into a terminal accommodating chamber 12, then perform the wire 4 pressuring operation, and thereafter perform the resin molding operation. Therefore, the assembling operation is readily responsive to automation. Still further, the interior of a terminal accommodating chamber 12 can be separated into the front chamber 12F and the back chamber 12B (resin charging space) by only setting a crimping terminal 20 to a predetermined position within the terminal accommodating chamber 12. Therefore, it is not necessary to arrange a separate shield member, which in turn allows the operations to be performed without interruption.

Still further, the elastic bent portion 24 is arranged in a crimping terminal 20 so as to be interposed between the shield wall 23 and the electric contact portion 21. Therefore, the electric contact portion 21 on the front end can be supported with some degree of play despite the fact that the back portion of the crimping terminal 20 is immovably fixed by the molding resin 30. As a result, errors to be found at the time of engaging a mating connector terminal with a corresponding electric contact portion 21 can be absorbed, which in turn permits smooth engagement.

It may be noted that in the case of the crimping connector 10 according to the first embodiment, the connector housing 11 must be set to the erect position at the time of charging the resin 30 since the back end face of the terminal accommodating chamber 12 is opened. Hence, if the wire pressuring process through the resin charging process are to be automated, a position changing step should be added, and this may brings about the problem of increased number of steps constituting the manufacturing process. To over come this problem, a next embodiment can be proposed.

Figure 4:
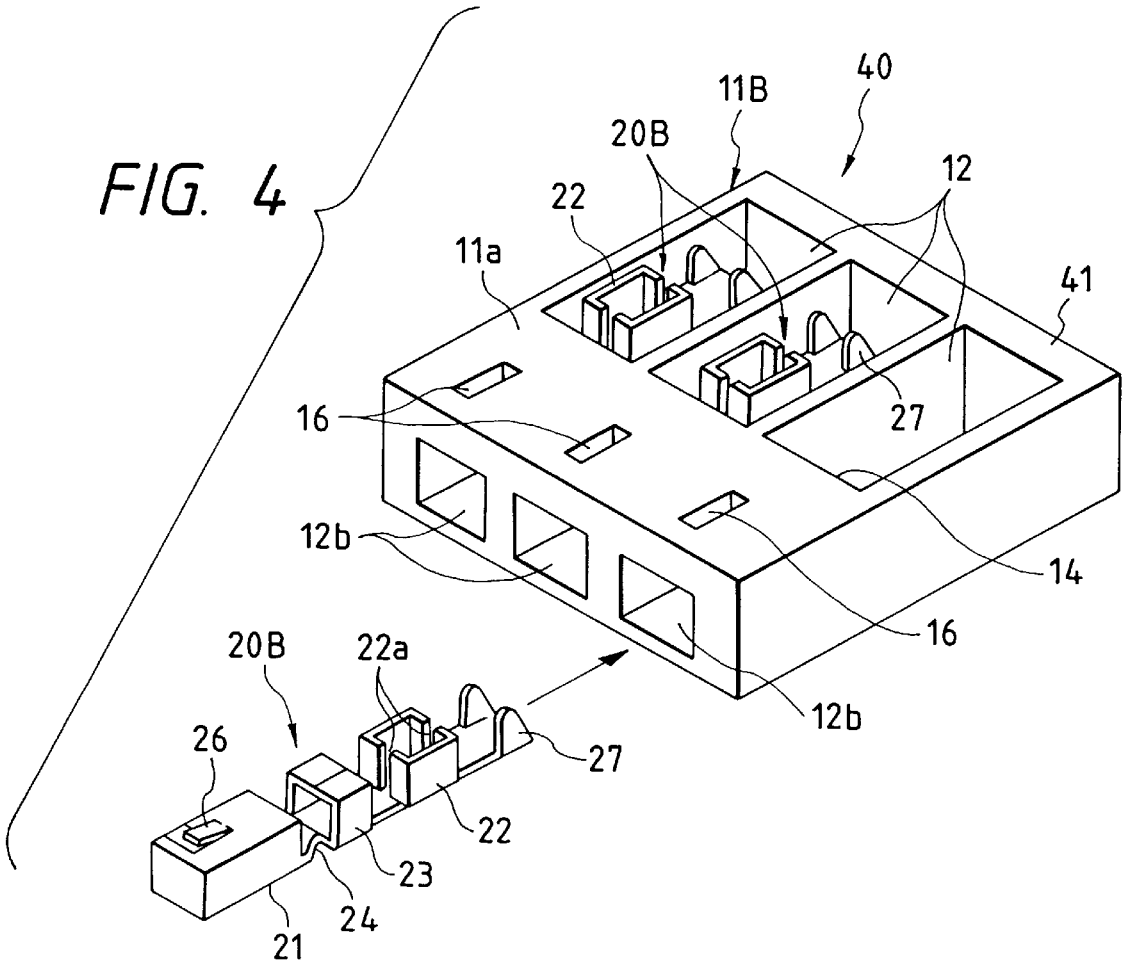
FIG. 4 is a perspective view showing a connector housing and a crimping terminal in a crimping connector, which is a second embodiment of the invention.
Figure 3A:
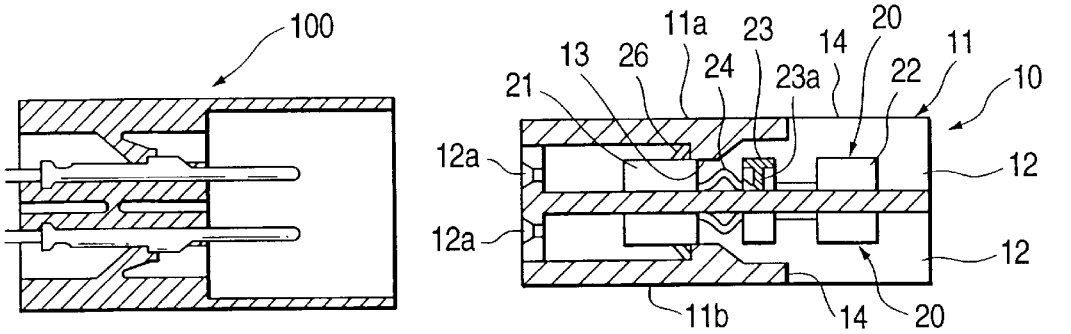
FIGS. 3(*a*) to 3(*d*) are side sectional views showing the process of manufacturing the crimping connector according to the first embodiment of the invention; i.e., FIG. 3(*a*) is a diagram showing a condition in which a crimping terminal is set to an operating position within a terminal accommodating chamber.
Figure 3B:
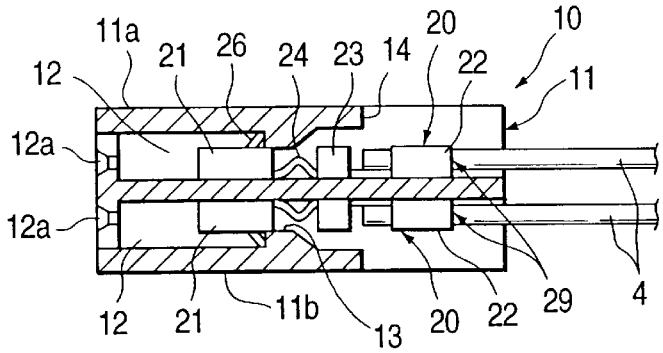
Figure 3C:
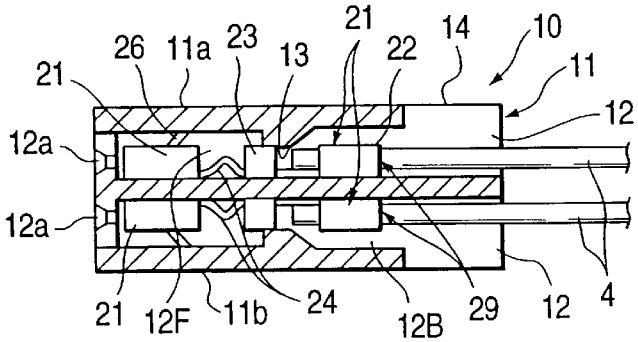
Figure 3D:
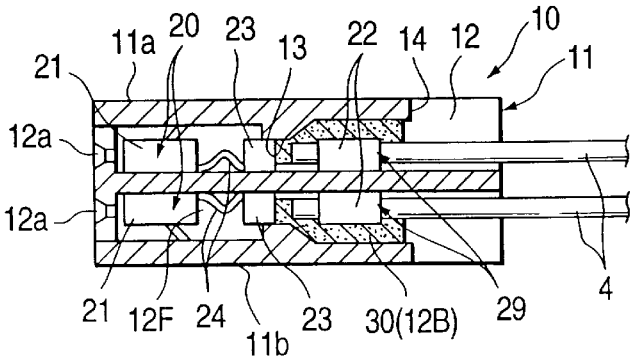
Figure 5A:
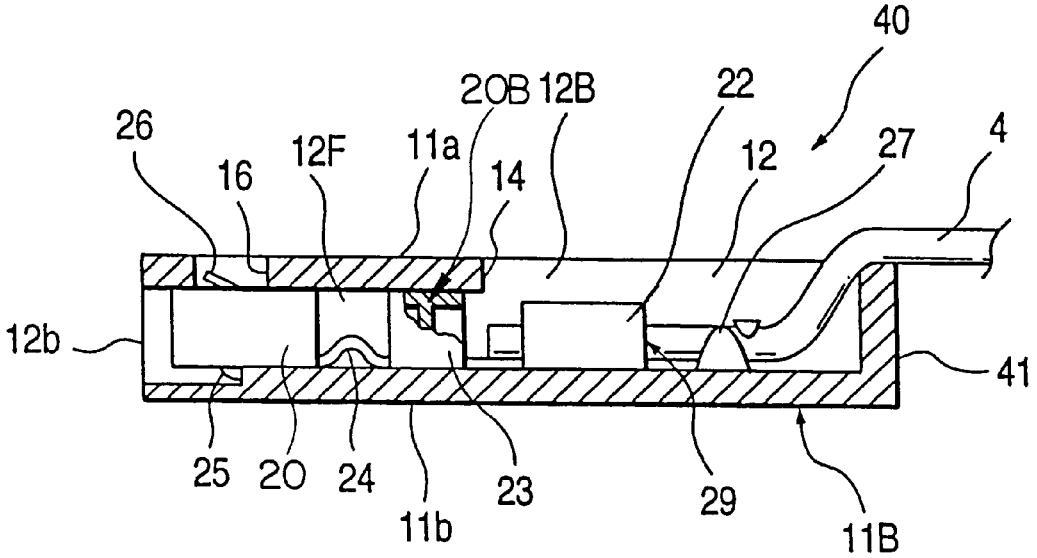
FIGS. 5(*a*) and 5(*b*) are side sectional views showing the process of manufacturing the crimping connector according to the second embodiment of the invention; i.e., FIG. 5(*a*) is a diagram showing a condition in which a crimping terminal is set in a terminal accommodating chamber and a wire is pressured and connected to a wire pressuring portion of the crimping terminal.
Figure 5B:
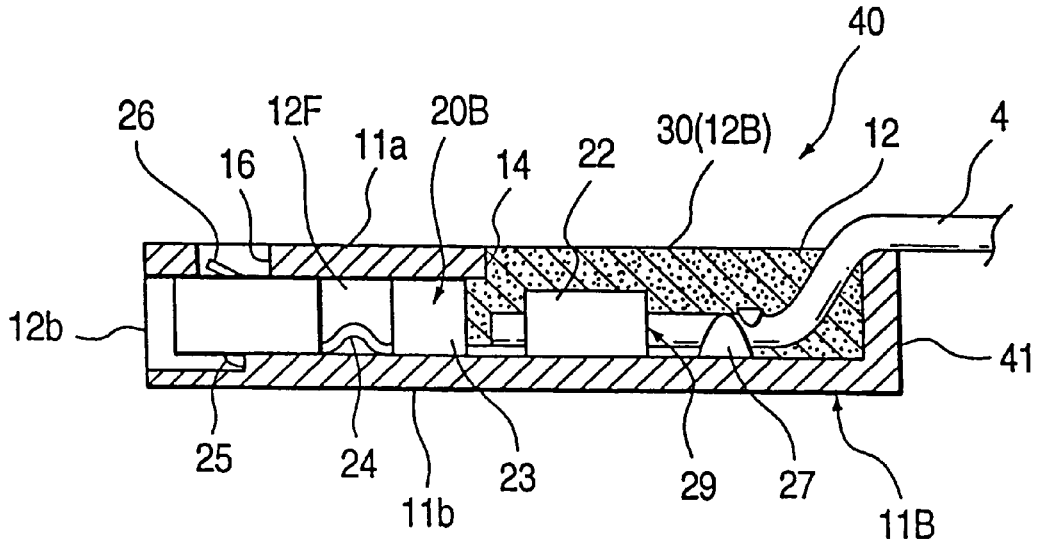

FIG. 4 is a perspective view of a crimping connector, which is a second embodiment, in a pre-assembled condition; and FIGS. 5(*a*) and 5(*b*) are side sectional views showing an assembling process for such crimping connector.

As shown in FIG. 4, this crimping connector 40 has, in a connector housing 11B thereof, not only openings 14 for opening the upper surfaces of the back chambers 12B of the terminal accommodating chambers 12 but also a back wall 41 for closing the back end faces of the back chambers 12 B. Since crimping terminals cannot be inserted from the back with the back end faces of the back chambers 12B closed, front holes 12*b* of the terminal accommodating chambers 12 are formed to be rather large so that crimping terminals can be inserted from the front. Further, there is only one story of the terminal accommodating chambers 12, and retaining holes 16 are formed in the upper wall 11*a*.

On the other hand, as shown in FIG. 5(*a*), a crimping terminal 20B has a stopper 25 against backward movement and a wire caulking portion 27 in addition to the electric contact portion 21, the wire pressuring portion 22, the shield wall 23, the elastic bent portion 24, and the retaining lane 26. The retaining lance 26 in this embodiment is so directed that the crimping terminal 20B is unreleasable from the front.

For assembling the crimping connector 40 according to this embodiment, first, the crimping terminals 20B are inserted and set into the respective terminal accommodating chambers 12 of the connector housing 11B from the front, and then, wires 4 are pressured and connected to the wire pressuring portions 22 from the upper openings 14 under the same condition. The interior of each terminal accommodating chamber 12 is separated into the front chamber 12F an the back chamber 12B under the same condition. Therefore, the molding resin 30 is charged into the back chamber 12B from the upper opening 14 of the back chamber 12B with the upper surface still faced upward. As a result, the resin 30 solidifies in the back chamber 12B defined by the back wall 41 and the shield wall 23 without leakage, so that the crimping connector 40 structured by molding the pressured and connected portion 29 of the wire with resin is completed.

This crimping connector 40 is characterized in that the resin 30 charging operation that comes next to the wire 4 pressuring operation can be performed without changing the posture of the connector housing 11B while leaving the posture taken during the wire pressuring operation unchanged. Therefore, the process of preparing the crimping connector 40 is suited for automation.

It may be noted that the second embodiment addresses a problem that the height of the crimping connector 40 is increased in order to match the arrangement thereof in which a wire 4 is extended by climbing over the upper end of the back wall 41. To overcome this problem, a next embodiment is proposed.

Figure 6A:
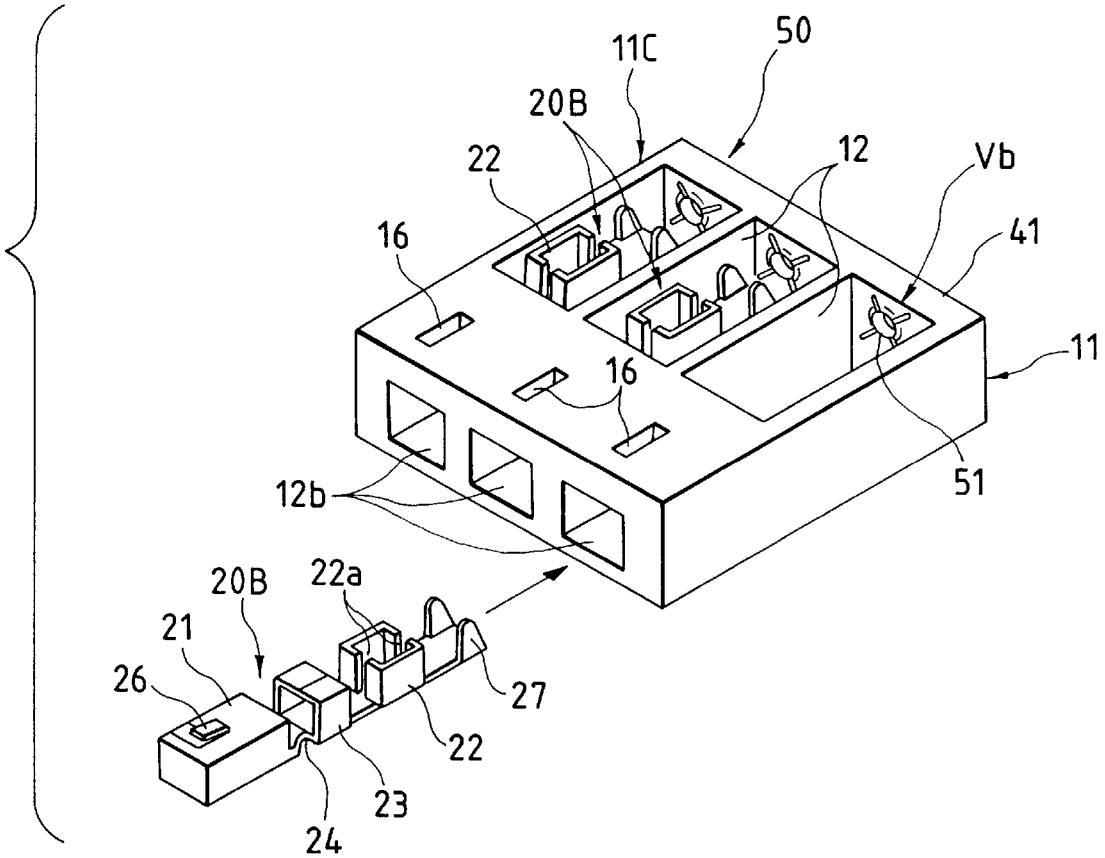
FIG. 6(*a*) is a perspective view showing a connector housing and a crimping terminal in a crimping connector, which is a third embodiment of the invention.
Figure 6B:
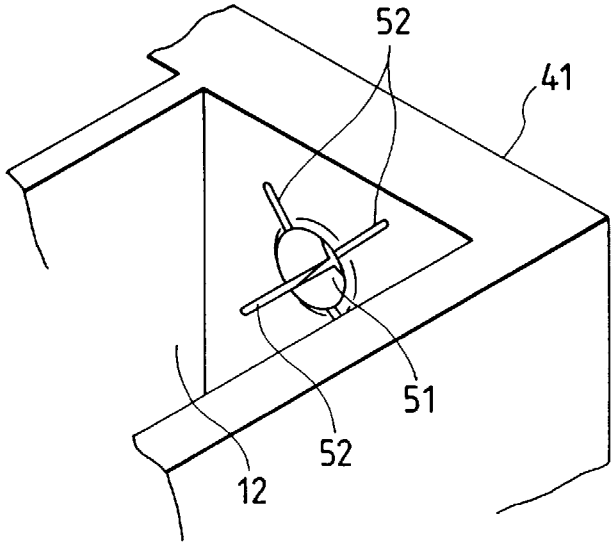

FIGS. 6(*a*) and 6(*b*) are perspective views of a crimping connector, which is a third embodiment, in a preassembled condition; i.e., FIG. 6(*a*) is a general view thereof and FIG. 6(*b*) is an enlarged view of a portion Vb of FIG. 6(*a*). Further, FIGS. 7(*a*) and 7(*b*) are side sectional views showing an assembling process for such crimping connector.

Figure 7A:
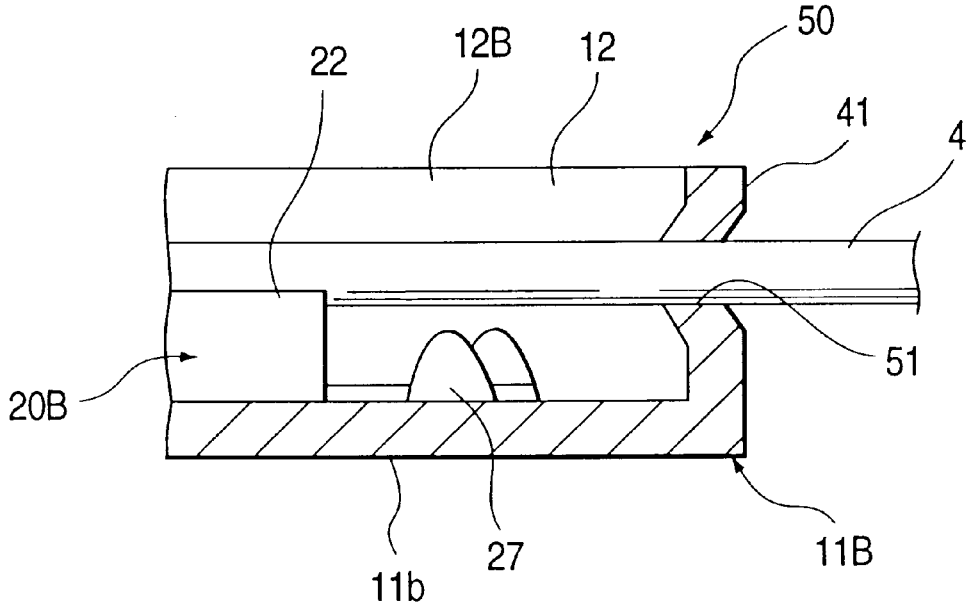
FIGS. 7(*a*) and 7(*b*) are side sectional views showing the process of manufacturing the crimping connector according to the third embodiment of the invention; i.e., FIG. 7(*a*) is a partially side sectional view showing a condition in which a wire is inserted into a wire insertion hole formed in the back wall of a terminal accommodating chamber.
Figure 7B:
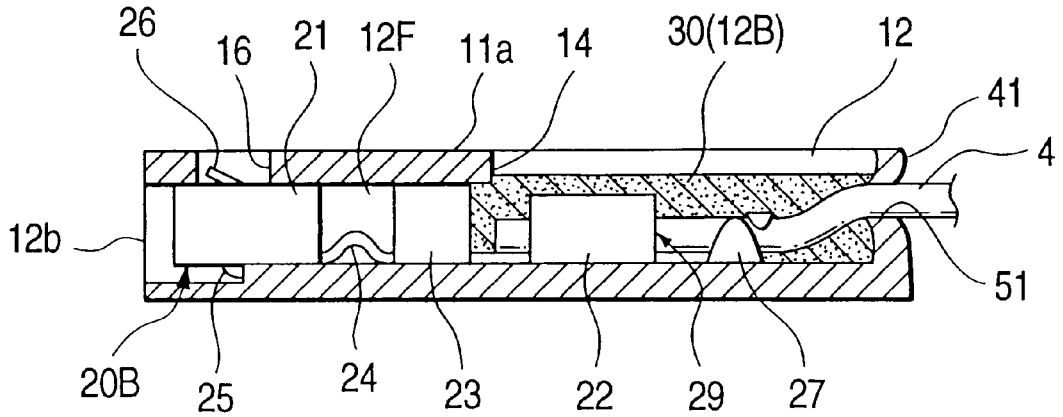

As shown in FIG. 6, this crimping connector 50 has wire insertion holes 51 in the back wall 41 of the terminal accommodating chambers 12 of a connector housing 11C. Each wire insertion hole 51 in this embodiment has dimensions large enough to be in intimate contact with a wire 4. As shown in FIG. 7(*b*), the wire insertion hole 51 is located so as to be of substantially the same height as the pressured and connected portion 29 of the wire. Further, around the wire insertion hole 51 are a plurality of radially extending slits 52. Other structural components are the same as those of the aforementioned second embodiment.

For assembling the crimping connector 50 according to this embodiment, a wire 4 is inserted into the wire insertion hole 51 arranged in the back wall 41 in advance as shown in FIG. 7(*a*). For the wire inserting operation, the wire 4 can be inserted into the wire insertion hole 51 easily with a small force, because the radially extending slits 52 are arranged in the wall around the wire insertion hole 51. Then, the wire 4 is pressured onto the wire pressuring portion 22 under the same condition, and the resin 30 is charged into the back chamber 12B. For the resin charging operation, leakage of the resin 30 charged into the back chamber 12B can be minimized since the wire insertion hole 51 is set so as to be large enough to be in intimate contact with the wire 4. The crimping connector 50 is completed when the resin 30 has solidified.

As shown in FIG. 7(*b*), this crimping connector 50 is characterized in that a wire 4 is not a hindrance and also in that the height of the connector 50 including the wire 4 can be set to a small value, because the wire 4 is not required to be extended so as to climb over the upper end of the back wall 41. Further, since the wire 4 is held by the circumferential surface of the wire insertion hole 51, reliable holding power can be given. Still further, since the wire insertion hole 51 is arranged so as to be of substantially the same height as the pressured and connected portion 29 of a wire 4, the wire 4 can be extended without being forcibly bent, etc.

Figure 8:
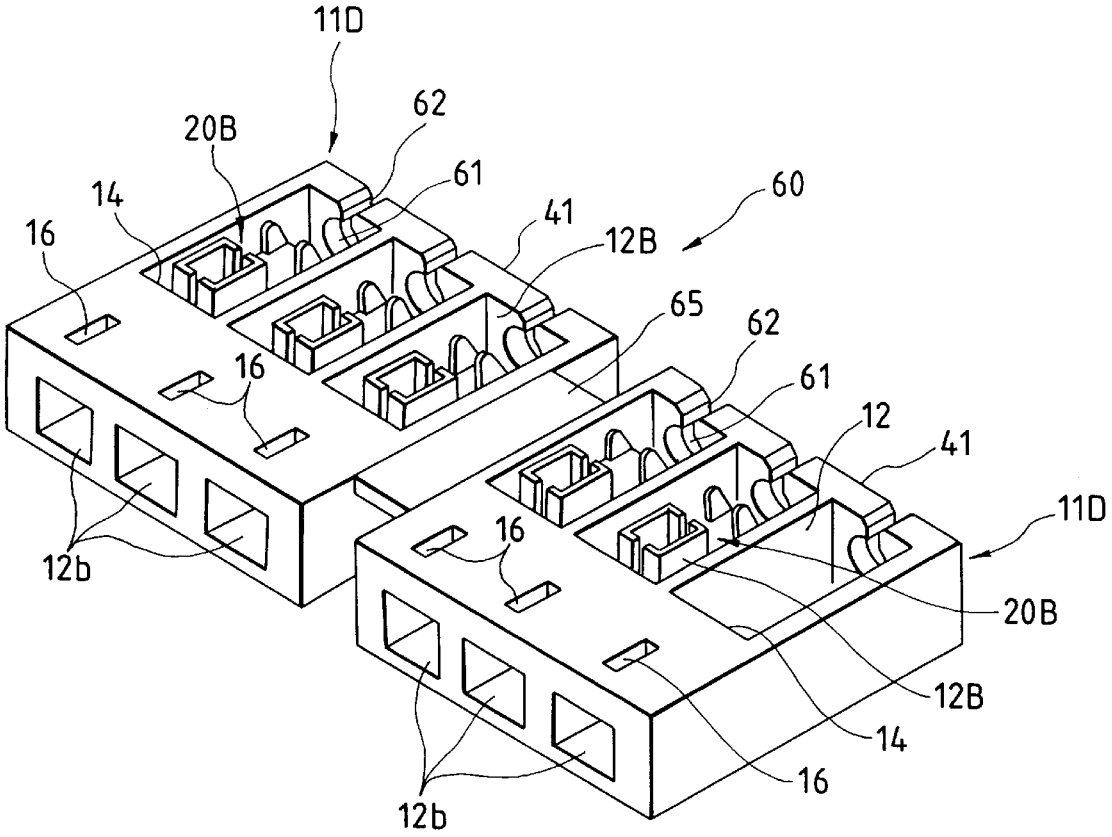
FIG. 8 is a perspective view showing a crimping connector, which is a fourth embodiment of the invention, before wires are pressured.
Figure 9A:
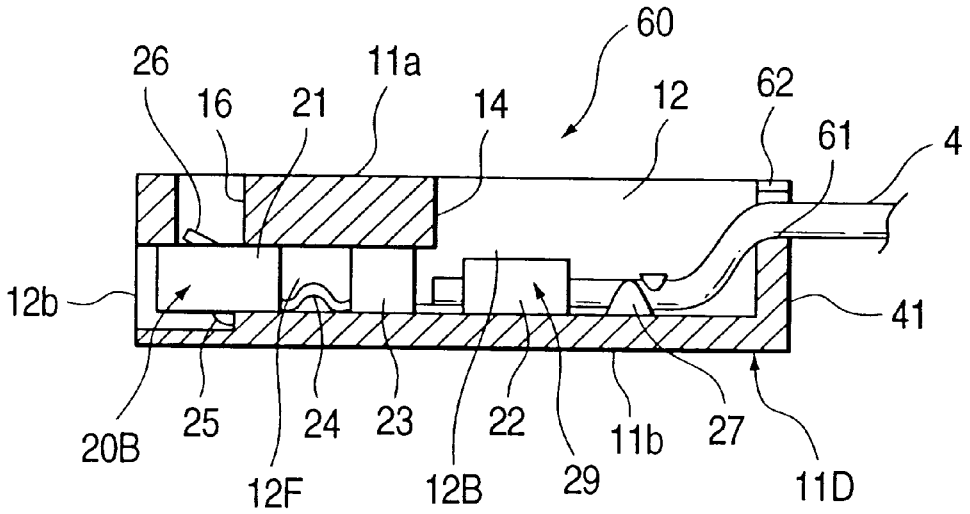
FIGS. 9(*a*) and 9(*b*) are side sectional views showing the process of manufacturing the crimping connector according to the third embodiment of the invention; i.e., FIG. 9(*a*) is a partially side sectional view showing a condition in which a wire is inserted into a wire insertion hole formed in the back wall of a terminal accommodating chamber.
Figure 9B:
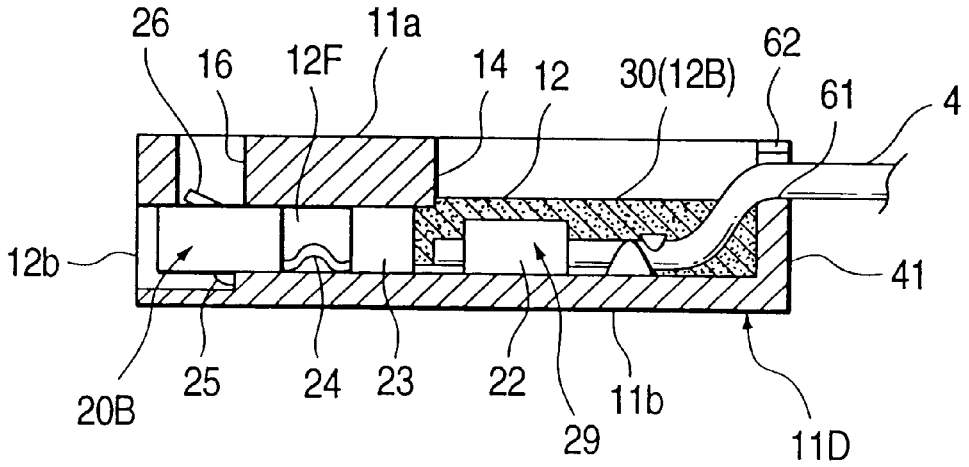

FIG. 8 and FIG. 9 show a fourth embodiment. FIG. 8 is a perspective view of a crimping connector according to the fourth embodiment in a pre-assembled condition; and FIGS. 9(*a*) and 9(*b*) are side sectional views showing an assembling process for such crimping connector.

This crimping connector 60 is formed by coupling two connector housings 11D of the same shape through a flexible coupling band 65. Each connector housing 11D is distinguished from the connector housing 11C according to the third embodiment in the following point. As shown in FIG. 8, not only a wire insertion hole 61 is arranged in the back wall 41 of the terminal accommodating chamber 12 so as to be positioned higher than a resin charging height in the back chamber 12B, but also a notch 62 is arranged above the wire insertion hole 61 in the back wall 41. The notch 62 allows a wire 4 to be inserted into the wire insertion hole 61 from above. Other than the above, the connector housing 11D has the same construction as the connector housing 11C according to the third embodiment.

The crimping connector 60 according to the fourth embodiment is characterized in that the thus constructed connector housings 11D are coupled to each other through the flexible coupling band 65 with the openings 14 of both connector housings faced upward.

For assembling this crimping connector 60, as shown in FIG. 9(*a*), a wire 4 is fitted into the wire insertion hole 61 arranged in the back wall 41 using the notch 62 in advance. Then, the wire 4 is pressured into the wire pressuring portion 22 under the same condition, and the resin 30 is charged into the back chamber 12B. The thus processed crimping connector 60 is left as it is until the resin 30 is solidified. In this case, since the wire insertion hole 61 is arranged at a level higher than the resin charging height, there is no danger of leaking the resin from the wire insertion hole 61 to the outside of the housings 11D. When the resin 30 has solidified, both connector housings 11D are combined together in such a manner that the openings 14 of one of the connector housings confront those of the other connector housing with the coupling band 65 serving as a hinge. As a result, a two-storied crimping connector 60 is assembled and completed.

In this case, by combining two connector housings 11D together, the mutually confronting openings 14 are closed, which means that no special cover is required. Further, the pressured and connected portions 29 of wires in the openings 14 are molded with resin, so that there is no likelihood that the pressured portions of the wires in one of the connector housings will come in contact with those in the other connector housing. In this sense also, there is no need for interposing a cover between both connector housings 11D in order to prevent both housings from coming in contact with each other, which in turn contributes to simplifying the structure of the crimping connector. Still further, the openings of both connector housings 11D are coupled in the same direction, so that the wire 4 pressuring operation and the resin 30 charging operation can be performed with respect to crimping terminals 20B within the two connector housings at the same time. Therefore, the crimping connector according to the fourth embodiment can readily be automated.

As described in the foregoing, according to the first aspect of the invention, the pressured and connected portion of a wire can be molded with resin by directly charging the resin into a connector housing while preventing the resin from entering into the electric contact portion of a crimping terminal accommodated in the connector housing. Therefore, there is no need for preparing a special mold for the molding operation, and in addition, the manufacturing process suitable for automation, i.e., the manufacturing process including the steps of: first inserting and setting a crimping terminal into a terminal accommodating chamber, then performing the wire pressuring operation, and thereafter molding the wire with resin, can be adopted. Further, the front chamber is shielded from the back chamber only by setting the crimping terminal to a predetermined position within the terminal accommodating chamber. Therefore, there is no need for arranging an independent shield member, which in turn contributes to reducing parts cost and eliminating cumbersome operation.

According to the second aspect of the invention, the following advantages can be provided in addition to the advantages provided by the first aspect of the invention. That is, according to the second aspect of the invention, the presence of the elastic bent portion arranged on a crimping terminal ensures a play of the electric contact portion. Therefore, when a mating connector terminal is fitted into the electric contact portion, errors of both members can be absorbed, which in turn permits smooth fitting operation.

According to the third aspect of the invention, the following advantages can be obtained in addition to the advantaged provided by either the first or the second aspect of the invention. That is, not only the upper surface of the back chamber of the connector housing is opened, but also the back wall for closing the back end face of the back chamber is arranged. Therefore, a molding resin can be charged from the opening formed in the upper surface. Therefore, the resin charging operation that comes next to the wire pressuring operation can be performed without changing the posture of the connector housing while leaving the posture taken during the wire pressuring operation unchanged. Therefore, the process of preparing the crimping connector is further suited for automation.

According to the fourth aspect of the invention, the following advantages can be provided in addition to the advantages provided by the third aspect of the invention. That is, a wire can be extended from the wire insertion hole formed in the back wall. Therefore, there is no need for extending the wire from the opening formed in the upper surface of the back chamber. As a result, the height of the connector including the wire can be reduced. In addition, reliable wire holding is ensured, and the wire is no longer a hindrance.

According to the fifth aspect of the invention, the following advantages can be provided in addition to the fourth aspect of the invention. That is, a wire insertion hole is arranged so as to be of substantially the same height as the pressured and connected portion of a wire. Therefore, the wire can be extended without being forcibly bent, etc. Further, the wire insertion hole is so dimensioned that the wire comes in intimate contact therewith. Therefore, leakage of the charged resin can be minimized. Still further, slits are arranged in the wall around the wire insertion hole. Therefore, the wire can be inserted into the wire insertion hole with ease.

According to the sixth aspect of the invention, the following advantages can be provided in addition to the advantages provided by the fourth aspect of the invention. That is, a notch is arranged above the wire insertion hole in the back wall. Therefore, a wire can be fitted into the wire insertion hole from above by utilizing the notch.

According to the seventh aspect of the invention, the following advantages can be provided in addition to the advantages provided by any one of the third to sixth aspects of the invention. That is, two connector housings are combined together. Therefore, the openings of one of the connector housings are concealed by the openings of the other connector housing. Further, the pressured and connected portion of a wire inside the opening is molded with resin. Therefore, even if both connector housings are combined together, there is no likelihood that the pressured and connected portion in one of the connector housings will come in contact with that in the other connector housing. Hence, there is no need for interposing a contact preventing cover between both connector housings, which in turn contributes to simplifying the structure of a two-staged connector.

According to the eighth aspect of the invention, the following advantages can be provided in addition to the advantages provided by the seventh aspect of the invention. That is, the two connector housings are coupled to each other through a coupling band in such a manner that the openings of one of the connector housings can confront those of the other connector housing at the time of combining the two connector housings together. Therefore, both connector housings can be handled as an integral part. Further, both connector housings can be combined together easily utilizing the coupling band as a hinge after the wire pressuring operation and the resin charging operation have been completed. Therefore, there is few need for setting the direction and position of both connector housings. Still further, both connector housings can be set with the openings thereof faced upward. Therefore, the wire pressuring operation and the resin charging operation can be performed under the same posture, which in turn contributes to automation.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A crimping connector comprising:

a connector housing having a terminal accommodating chamber;

a crimping terminal inserted and set into said terminal accommodating chamber of said connector housing, said crimping terminal having an electric contact portion relative to a mating connector terminal on a front end thereof and a wire pressure portion on a back end thereof; and a wire pressured and connected to said wire pressuring portion;

wherein said crimping terminal is provided with a shield wall, arranged only between the wire pressuring portion and the electric contact portion of the crimping terminal, which abuts against interior walls of said terminal accommodating chamber for separating an interior of said terminal accommodating chamber into a front chamber accommodating said electric contact portion and a back chamber accommodating said wire pressuring portion, and a resin is charged into said back chamber so as to cover a pressured and connected portion of the wire connected to said wire pressuring portion.

2. A crimping connector according to claim 1, wherein said crimping terminal is provided with an elastically deformable portion which is arranged between said shield wall and said electric contact portion of the crimping terminal for allowing slight movement of the electric contact portion.

3. A crimping connector according to claim 2, wherein said connector housing is provided with an opening portion allowing an upper surface of the back chamber to open and a back wall allowing a back end face of the back chamber to close.

4. A crimping connector according to claim 3, wherein a wire insertion hole is formed in said back wall.

5. A crimping connector according to claim 4, wherein said wire insertion hole is formed so as to be large enough to allow the wire to be in intimate contact therewith and so as to be of substantially the same height as the pressured and connected portion of the wire; and a plurality of radially extending slits are formed around said wire insertion hole.

6. A crimping connector according to claim 4, wherein the wire insertion hole is arranged at a level higher than a resin charging height in the back chamber, and also a notch allowing the wire to be inserted into the wire insertion hole from above is formed above the wire insertion hole in the back wall.

7. A crimping connector according to claim 3, wherein said connector housing comprises two connector housing members each having said terminal accommodating chamber with said opening portion allowing an upper surface of the back chamber to open, and said two connector housing members are combined so as to confront said opening portion of one of said connector housing members with said opening portion of the other connector housing members.

8. A crimping connector according to claim 4, wherein said connector housing comprises two connector housing members each having said terminal accommodating chamber with said opening portion allowing an upper surface of the back chamber to open, and said two connector housing members are combined so as to confront said opening portion of one of said connector housing members with said opening portion of the other connector housing members.

9. A crimping connector according to claim 5, wherein said connector housing comprises two connector housing members each having said terminal accommodating chamber with said opening portion allowing an upper surface of the back chamber to open, and said two connector housing members are combined so as to confront said opening portion of one of said connector housing members with said opening portion of the other connector housing members.

10. A crimping connector according to claim 6, wherein said connector housing comprises two connector housing members each having said terminal accommodating chamber with said opening portion allowing an upper surface of the back chamber to open, and said two connector housing members are combined so as to confront said opening portion of one of said connector housing members with said opening portion of the other connector housing members.

11. A crimping connector according to claim 7, wherein said two connector housing members are coupled to each other through a coupling band in such a manner that said opening portion of said one of said connector housing members confront said opening portion of said other connector housing members while said two connector housing members are combined.

12. A crimping connector according to claim 8, wherein said two connector housing members are coupled to each other through a coupling band in such a manner that said opening portion of said one of said connector housing members confront said opening portion of said other connector housing members while said two connector housing members are combined.

13. A crimping connector according to claim 9, wherein said two connector housing members are coupled to each other through a coupling band in such a manner that said opening portion of said one of said connector housing members confront said opening portion of said other connector housing members while said two connector housing members are combined.

14. A crimping connector according to claim 10, wherein said two connector housing members are coupled to each other through a coupling band in such a manner that said opening portion of said one of said connector housing members confront said opening portion of said other connector housing members while said two connector housing members are combined.

15. A crimping connector according to claim 1, wherein said connector housing is provided with an opening portion allowing an upper surface of the back chamber to open and a back wall allowing a back end face of the back chamber to close.

16. A crimping connector according to claim 15, wherein a wire insertion hole is formed in said back wall.

17. A crimping connector according to claim 16, wherein said wire insertion hole is formed so as to be large enough to allow the wire to be in intimate contact therewith and so as to be of substantially the same height as the pressured and connected portion of the wire; and a plurality of radially extending slits are formed around said wire insertion hole.

18. A crimping connector according to claim 16, wherein the wire insertion hole is arranged at a level higher than a resin charging height in the back chamber, and also a notch allowing the wire to be inserted into the wire insertion hole from above is formed above the wire insertion hole in the back wall.

19. A crimping connector according to claim 15, wherein said connector housing comprises two connector housing members each having said terminal accommodating chamber with said opening portion allowing an upper surface of the back chamber to open, and said two connector housing members are combined so as to confront said opening portion of one of said connector housing members with said opening portion of the other connector housing members.

20. A crimping connector according to claim 16, wherein said connector housing comprises two connector housing members each having said terminal accommodating chamber with said opening portion allowing an upper surface of the back chamber to open, and said two connector housing members are combined so as to confront said opening portion of one of said connector housing members with said opening portion of the other connector housing members.

21. A crimping connector according to claim 17, wherein said connector housing comprises two connector housing members each having said terminal accommodating chamber with said opening portion allowing an upper surface of the back chamber to open, and said two connector housing members are combined so as to confront said opening portion of one of said connector housing members with said opening portion of the other connector housing members.

22. A crimping connector according to claim 18, wherein said connector housing comprises two connector housing members each having said terminal accommodating chamber with said opening portion allowing an upper surface of the back chamber to open, and said two connector housing members are combined so as to confront said opening portion of one of said connector housing members with said opening portion of the other connector housing members.

23. A crimping connector according to claim 19, wherein said two connector housing members are coupled to each other through a coupling band in such a manner that said opening portion of said one of said connector housing members confront said opening portion of said other connector housing members while said two connector housing members are combined.

24. A crimping connector according to claim 20, wherein said two connector housing members are coupled to each other through a coupling band in such a manner that said opening portion of said one of said connector housing members confront said opening portion of said other connector housing members while said two connector housing members are combined.

25. A crimping connector according to claim 21, wherein said two connector housing members are coupled to each other through a coupling band in such a manner that said opening portion of said one of said connector housing members confront said opening portion of said other connector housing members while said two connector housing members are combined.

26. A crimping connector according to claim 22, wherein said two connector housing members are coupled to each other through a coupling band in such a manner that said opening portion of said one of said connector housing members confront said opening portion of said other connector housing members while said two connector housing members are combined.

27. The crimping connector of claim 1, wherein said shield wall includes a plate member extending substantially transversely to a longitudinal axis of said crimping terminal and said terminal accommodating chamber.

28. The crimping connector of claim 1, wherein said shield wall is fully received in an internal portion of said terminal accommodating chamber so as to not protrude therefrom.

* * * * *